US009011042B2

(12) United States Patent
Nakayasu et al.

(10) Patent No.: US 9,011,042 B2
(45) Date of Patent: Apr. 21, 2015

(54) FLOATING BODY CONNECTION-TYPE FLAP GATE

(75) Inventors: Kyouiti Nakayasu, Osaka (JP); Toshiaki Morii, Osaka (JP); Yuitirou Kimura, Osaka (JP); Hideyuki Niizato, Osaka (JP)

(73) Assignee: Hitachi Zosen Corporation, Osaka (JP)

( * ) Notice: Subject to any disclaimer, the term of this patent is extended or adjusted under 35 U.S.C. 154(b) by 0 days.

(21) Appl. No.: 13/522,842

(22) PCT Filed: Oct. 5, 2010

(86) PCT No.: PCT/JP2010/067463

§ 371 (c)(1),
(2), (4) Date: Jul. 18, 2012

(87) PCT Pub. No.: WO2011/092897

PCT Pub. Date: Aug. 4, 2011

(65) Prior Publication Data

US 2012/0294678 A1 Nov. 22, 2012

(30) Foreign Application Priority Data

Jan. 27, 2010 (JP) ..... 2010-015823

(51) Int. Cl.
*E02B 3/20* (2006.01)
*E02B 3/10* (2006.01)

(52) U.S. Cl.
CPC ..... *E02B 3/102* (2013.01)

(58) Field of Classification Search
USPC ..... 405/92–94, 96, 99, 100, 104, 105
See application file for complete search history.

(56) References Cited

U.S. PATENT DOCUMENTS 579,349 A * 3/1897 Marshall ..... 405/94
602,803 A * 4/1898 Groom ..... 405/100
2,183,288 A * 12/1939 Cicin ..... 405/104

(Continued)

FOREIGN PATENT DOCUMENTS

CN 2045759 U 10/1989
GB 2183719 A * 6/1987 ..... E05D 7/085

(Continued)

OTHER PUBLICATIONS

International Search Report for International Application No. PCT/JP2010/067463, dated Nov. 9, 2010, 2 pages.

(Continued)

*Primary Examiner* — Thomas B Will
*Assistant Examiner* — Jessica H Lutz
(74) *Attorney, Agent, or Firm* — Brinks Gilson & Lione

(57) ABSTRACT

To prevent a door body from shaking significantly when it rises. A floating body flap gate is provided which is disposed on a roadway surface in an opening; and causes a door body to rise to block the opening when water is trying to flow in from the opening by using a water pressure of the water which is trying to flow in and a buoyancy of the door body. The door body is formed with three door body blocks, which are separated in the vertical direction. These door body blocks which are separated in the vertical direction, are connected by rotation mechanisms for rotation at a specified angle within a vertical plane in a direction in which the water is trying to flow in from the opening. The door body is not subject to significant shaking, regardless of the water level at which the water tries to flow in from the opening.

7 Claims, 8 Drawing Sheets

(56) References Cited

U.S. PATENT DOCUMENTS

| | | | | |
|---|---|---|---|---|
| 6,453,483 | B1 * | 9/2002 | Jacuzzi et al. | 4/507 |
| 6,623,209 | B1 * | 9/2003 | Waters, Jr. | 405/94 |
| 7,033,112 | B2 * | 4/2006 | Rijlaarsdam | 405/87 |
| 7,121,764 | B2 * | 10/2006 | Rorheim | 405/107 |
| 7,302,221 | B2 * | 11/2007 | Shyu | 399/367 |
| 7,467,911 | B2 * | 12/2008 | Flury | 405/94 |
| 2008/0014021 | A1 | 1/2008 | Flury | |

FOREIGN PATENT DOCUMENTS

| | | | | | |
|---|---|---|---|---|---|
| JP | 57-193721 | U | | 12/1982 | |
| JP | 58-013815 | A | | 1/1983 | |
| JP | 58013815 | A | * | 1/1983 | E02B 7/50 |
| JP | 2001-214425 | A | | 8/2001 | |
| JP | 2003-064646 | A | | 3/2003 | |
| JP | 2003-253912 | A | | 9/2003 | |
| JP | 2009-299427 | A | | 12/2009 | |
| JP | 2011202474 | A | * | 10/2011 | E02B 7/40 |
| KR | 100912197 | B1 | | 8/2009 | |

OTHER PUBLICATIONS

International Preliminary Report on Patentability for International Application No. PCT/JP2010/067463, dated Sep. 18, 2012, 5 pages.

* cited by examiner (a)

(b)

FLOATING BODY CONNECTION-TYPE FLAP GATE

This application is a 371 application of PCT/JP2010/067463 having an international filing date of Oct. 5, 2010, which claims priority to JP 2010-015823 filed Jan. 27, 2010, the entire contents of which are incorporated herein by reference.

TECHNICAL FIELD

The present invention relates to a floating body connection-type flap gate which is installed at an opening in a seawall to prevent a rising water from flowing into a public space at a time of rising water, by using the pressure of the water which is trying to flow in and the buoyancy of a door body to raise the door body, so as to block the opening.

BACKGROUND ART

There are cases in which a floating body flap gate which blocks an opening is installed at an opening of a seawall to prevent the rising water from flowing into a public space at the time of rising water (e.g., Patent Reference 1 and Patent Reference 2).

This type of floating body flap gate has a door body with a single large floating body, and the door body is raised by using the pressure of the water which is trying to flow in from an opening in a seawall and a buoyancy of the door body itself, to block the opening.

However, the door body of a conventional floating body flap gate was formed as a single unit in a vertical direction. Consequently, as shown in FIG. 9, there was a problem of a high risk of a significant shaking of the door body, because the entire door body rises at once when a water level reaches a certain height. In FIG. 9, d is an opening in a seawall, 2 is a door body of a floating body flap gate disposed at the opening, and w is water.

When water first starts to flow into the opening, since the door does not rise in response to the influx of the water and starts to rise after the influx of water, there is a problem that the water infiltrates from the opening during the period in which the rising of the door is delayed.

Moreover, if water flows in with a high hydrodynamic force (a swift current or a rapids) while the door rises, there is also a problem that the door body is subjected to a massive shock when it completes the rising movement, which damages the door body.

Patent Reference 1: Japanese Patent Application Kokai Publication No. 2001-214425

Patent Reference 2: Japanese Patent Application Kokai Publication No. 2003-253912

SUMMARY OF THE INVENTION

Problems to be Solved by the Invention

The problem which the present invention aims to solve is that when the water level reaches a certain height, in the conventional floating body flap gate which was disposed to block an opening in a seawall, the entire door body rises at once, which resulted in there being a problem of a high risk of a significant shaking of the door body. There was also a problem of water leaking when water first starts to flow into the opening, because the door starts to rise after the influx of water. Moreover, if water flows in with a high hydrodynamic force while the door rises, there is a problem of damage to the door body.

Means for Solving this Problem

The floating body connection-type flap gate according to the present invention is a floating body flap gate which comprises a door body disposed on a roadway surface in an opening and rises to block the opening, when water is trying to flow in from the opening, by using a water pressure of the water which is trying to flow in and a buoyancy of the door body. In order to prevent the door body from shaking significantly, the door body formed with two or more door body blocks which are separated in the vertical direction. These door body blocks which are separated in the vertical direction are connected by a rotation mechanism for rotation at a specified angle within a vertical plane in a direction in which the water is trying to flow in from the opening.

According to the present invention, the door body as a whole does not shake significantly, regardless of the water level, because the door body blocks which are separated in the vertical direction rotatively rise sequentially in an order starting from the roadway surface side.

In the present invention, a door body block at the forward end in the vertical direction is configured to rotate at a specified angle in a direction opposite to the direction in which water is trying to flow in from the opening. With the configuration, the door body block at the forward end rises ahead of the influx of water. In this case, the water that flows in from the opening is directed to the lower side of the door body block which is in a lowered state, and causes the water pressure to be utilized in a diagonal direction at the lower side of the door body. Accordingly, the operation of raising the door body block increases in speed when the water starts to flow into the opening, thereby making it possible to prevent the influx of water from the opening, and making it possible to prevent water from leaking.

In addition, in the present invention, the range of the angle of rotation of the rotation mechanism provided between the door body blocks which are separated in the vertical direction is smaller than the range of the angle of rotation of the rotation mechanism provided between a base end door body block and the roadway surface. If constructed in this manner, the upper door body blocks are set to be raised immediately before the base end door body block has finished rising. Therefore, when the door body stops rising, the shock imparted to the base end door body block is mitigated, with the result that there is no damage to the door body, even if there is an influx of water with a high hydrodynamic force while the door body is rising.

Advantageous Effects of the Invention

According to the present invention, the door body blocks which are separated in the vertical direction from the roadway surface rotatively rise sequentially from the roadway surface side in an order starting from the roadway surface side, so that the door body is not subject to significant shaking, regardless of the water level at which the water tries to flow in from the opening.

BRIEF DESCRIPTION OF THE DRAWINGS

FIG. 4(*b*) is a side view of FIG. 4(*a*); and FIG. 4(*c*) is a drawing illustrating the state when rotation occurs at a specified angle in a direction in which water is trying to flow in from the opening.

DETAILED DESCRIPTION OF THE PREFERRED EMBODIMENTS

According to the present invention, the object of preventing the door body from shaking significantly when it rises is achieved by means of two or more door body blocks separated in the vertical direction so as to be rotatable for a specified angle within a vertical plane in a direction in which water is trying to flow in from the opening.

Example

An example of the present invention is described in detail below using FIG. 1 to FIG. 8.

Figure 1:
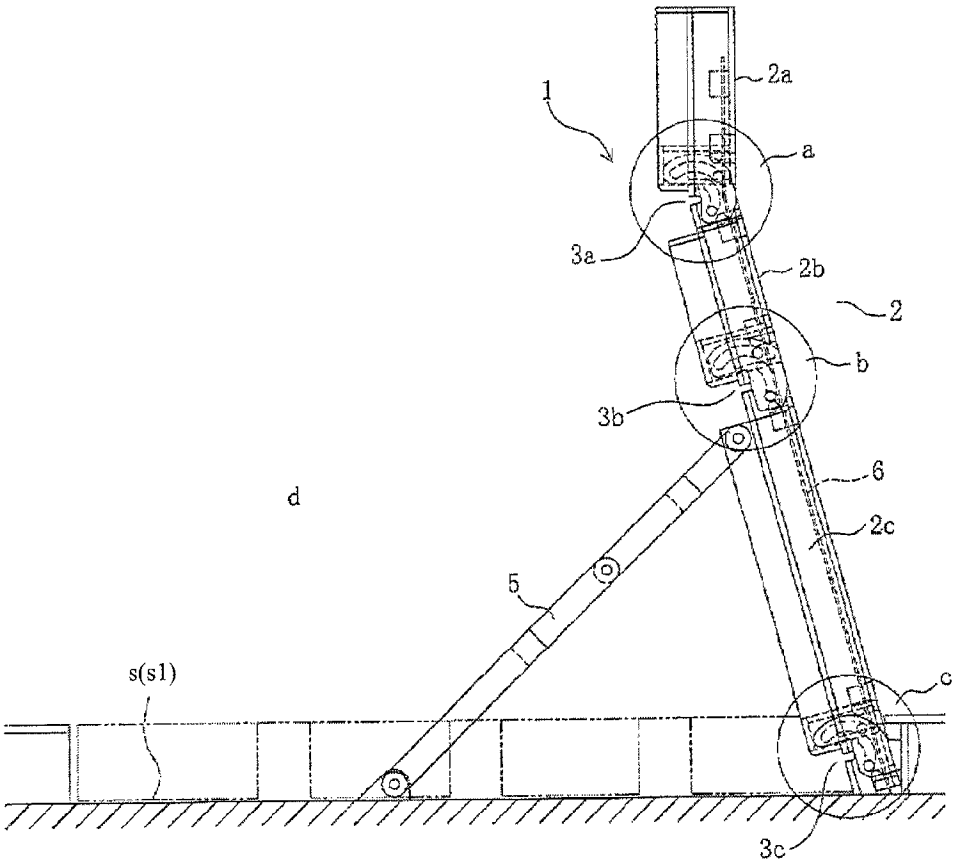
FIG. 1 is a drawing of the floating body connection-type flap gate of the present invention in the raised state, as viewed from the side.
Figure 2:
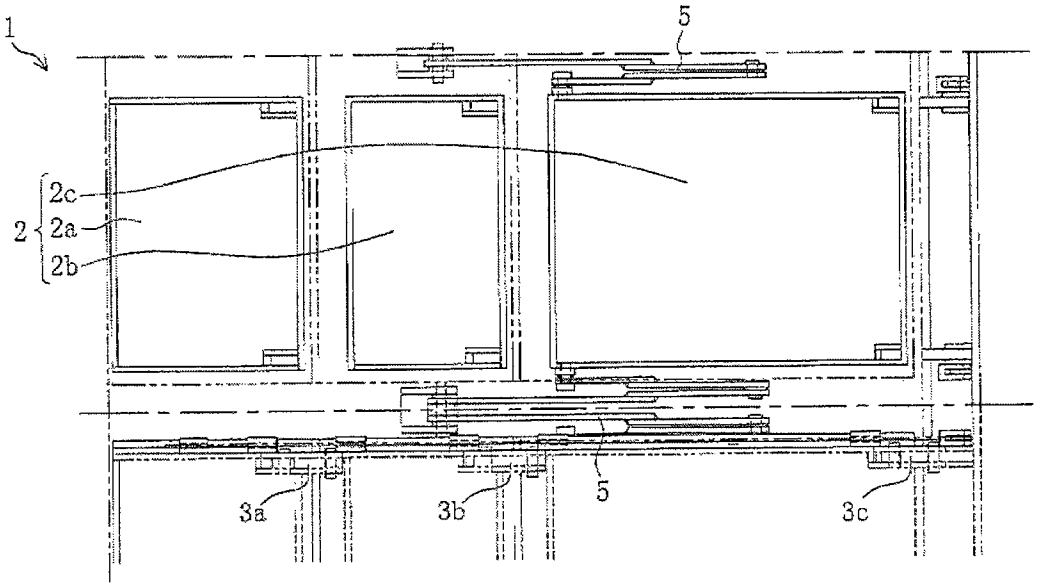
FIG. 2 is a drawing of the floating body connection-type flap gate of the present invention in the lowered state, as viewed from above.
Figure 3:
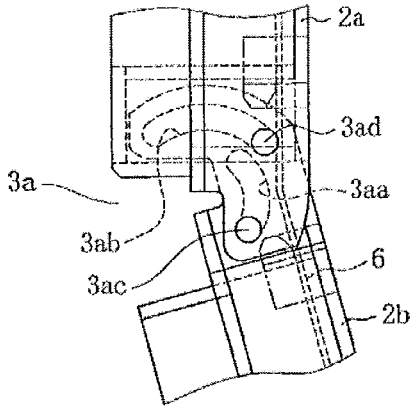
FIGS. 3(*a*) and 3(*b*) are drawings illustrating the circled portion a in FIG. 1, where FIG. 3(*a*) is an enlarged view, and FIG. 3(*b*) is a drawing illustrating the state when rotation occurs at a specified angle in a direction in which water is trying to flow in from the opening.
Figure 3:
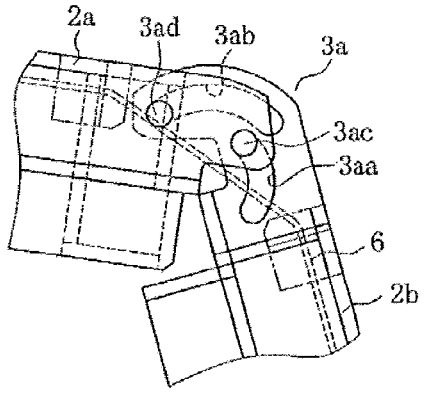
Figure 4:
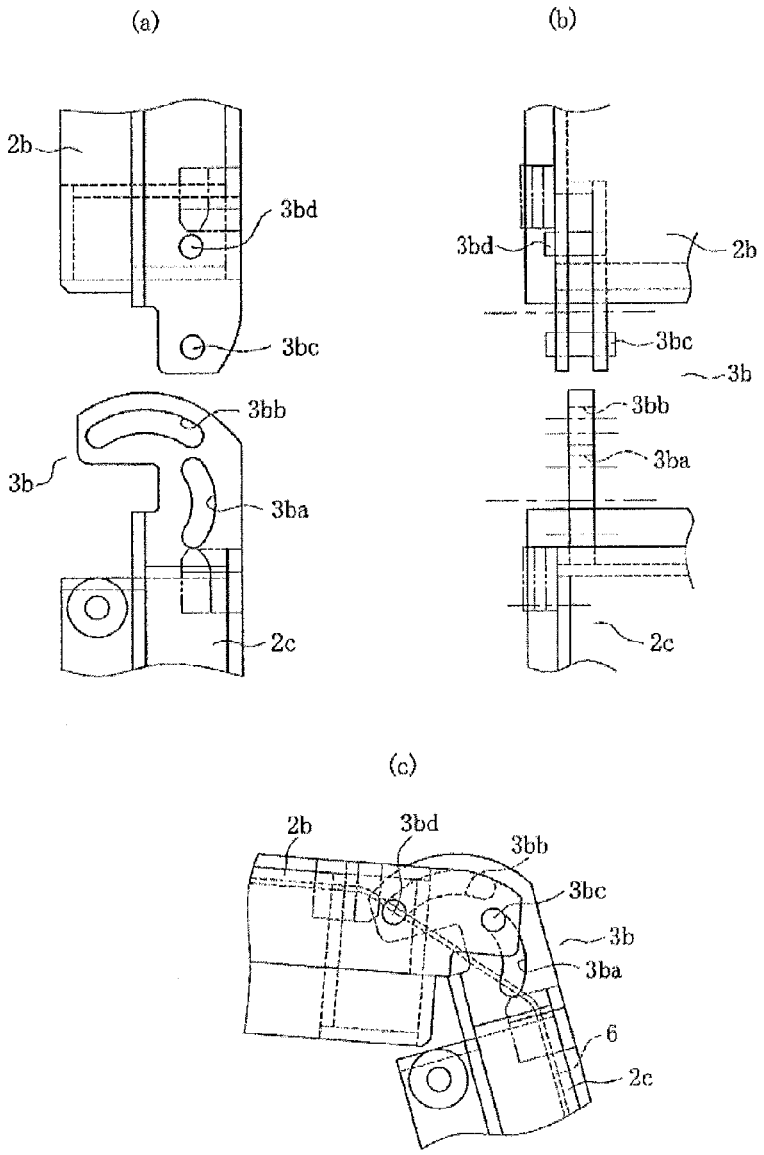
FIGS. 4(*a*), 4(*b*) and 4(*c*) are drawings illustrating the circled portion b in FIG. 1, where FIG. 4(*a*) is an enlarged view of the state prior to connection, as seen from the side.
Figure 5:
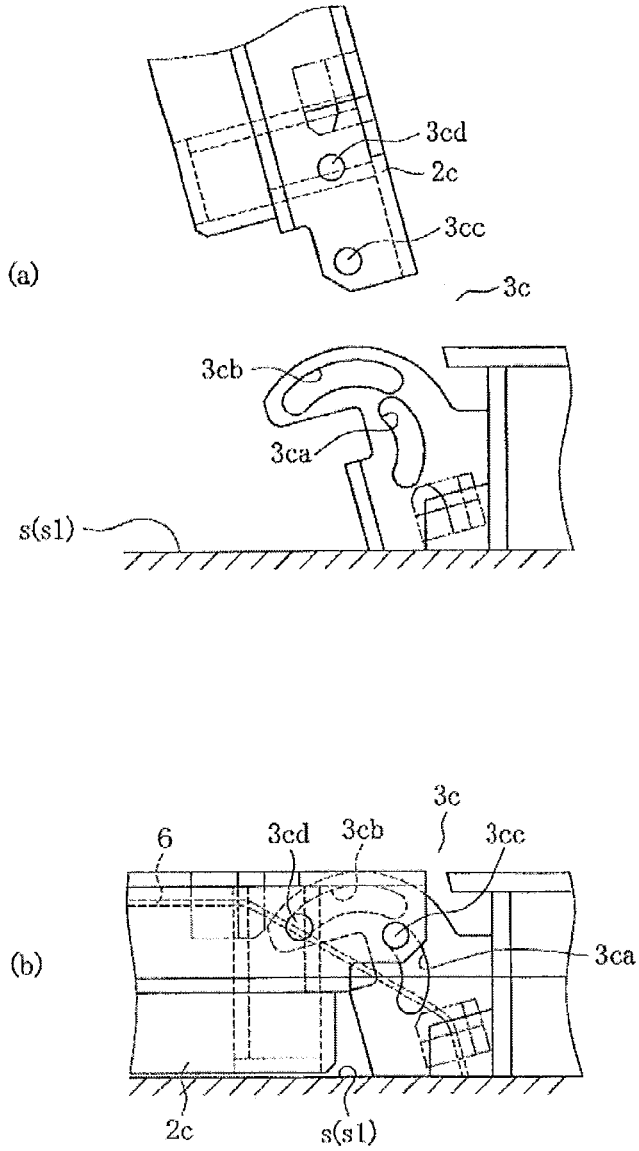
FIGS. 5(*a*) and 5(*b*) are drawings illustrating the circled portion c in FIG. 1, where FIG. 5(*a*) is a view of the state prior to connection, as seen from the side, and FIG. 5(*b*) is a drawing showing a lowered state.
Figure 6:
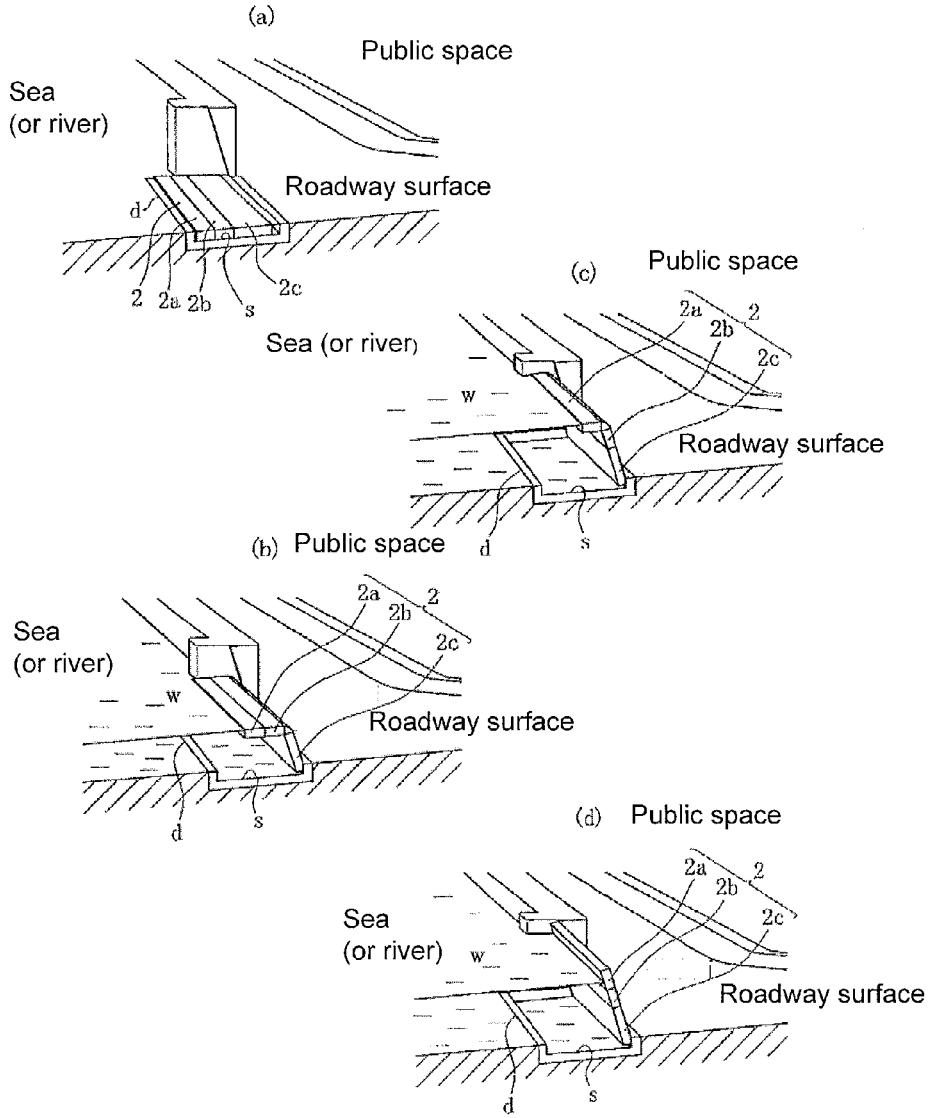
FIGS. 6 (*a*)-(*d*) are drawings illustrating the raised state of the floating body connection-type flap gate of the present invention, following in a step-by-step sequence.
Figure 7:
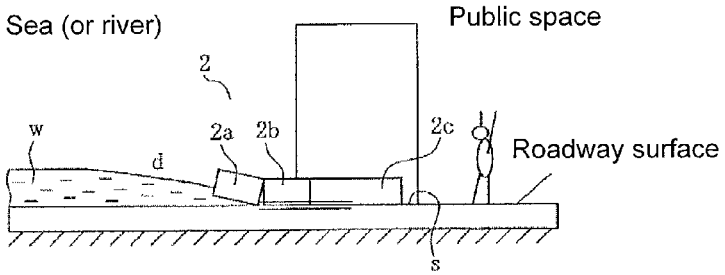
FIG. 7 is a drawing illustrating a state wherein the door body block at the forward end rises ahead of the influx of water.
Figure 8:
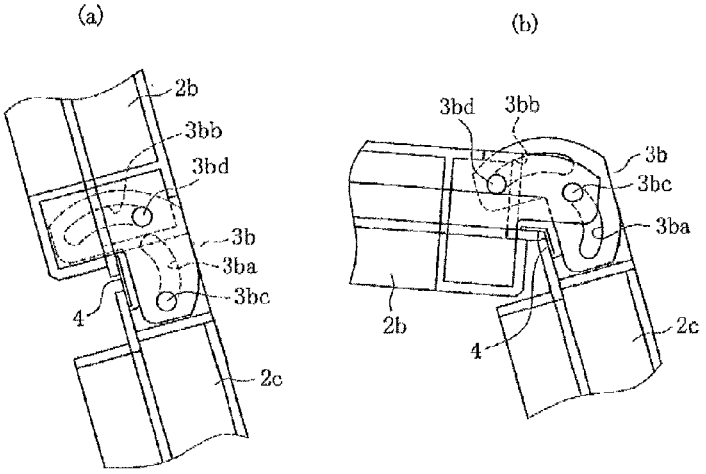
FIG. 8 is a drawing illustrating a water-tight member provided at the parts connecting the door body blocks to each other, where (a) is a drawing of the elongated state, and (b) is a drawing of the bent state.
Figure 9:
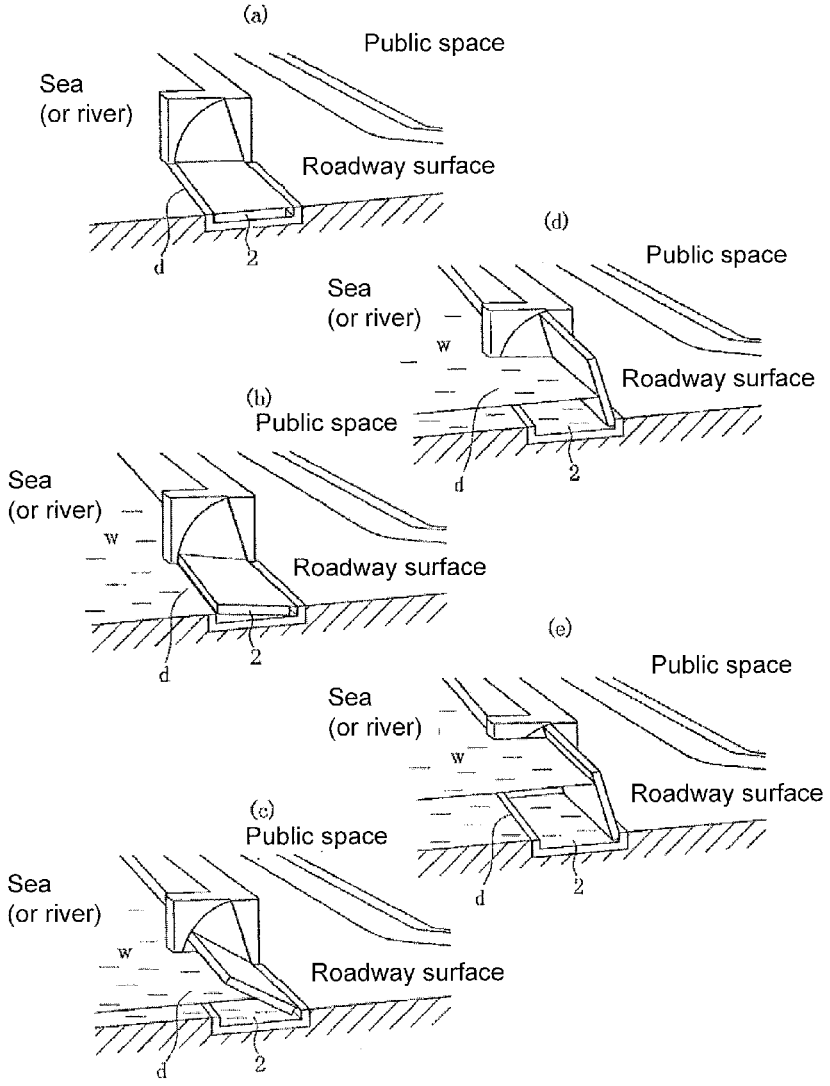
FIG. 9 PRIOR ART
FIGS. 9 (*a*)-(*e*) are drawings illustrating the raised state of a conventional floating body flap gate, following in a step-by-step sequence.

FIG. 1 is a drawing of the floating body connection-type flap gate of the present invention in the raised state, as viewed from the side; FIG. 2 is a drawing of the floating body connection-type flap gate of the present invention in the lowered state, as viewed from above; FIG. 3 to FIG. 5 are enlarged views of circled portion a to circled portion c which appear in FIG. 1; FIG. 6 is a drawing illustrating the raised state of the floating body connection-type flap gate of the present invention, following in a step-by-step sequence; FIG. 7 is a drawing illustrating a state wherein the door body block at the forward end rises ahead of the influx of water; and FIG. 8 is a drawing illustrating a water-tight member provided at the parts connecting the door body blocks to each other.

In FIG. 1 to FIG. 8, Reference Numeral 1 is a floating body connection-type flap gate according to the present invention, which is disposed on a roadway surface s at an opening d in a seawall. When a water w tries to flow from the opening d (in the right-hand direction in FIG. 1) into a public space (the roadway surface), the floating body connection-type flap gate 1 uses the pressure of the water w which is trying to flow in and the buoyancy of the door body 2 to cause a door body 2 to rise, thereby blocking the opening d.

The manner in which the floating body connection-type flap gate 1 is disposed on the roadway surface s at the opening d in a seawall may be one of two types, namely a buried type shown in FIG. 1 or a mounted type which is not depicted, and either mode of installation may be employed.

The type which is buried in the roadway surface has a concave surface s1 (a buried pit) formed in the roadway surface s at the opening d, and is constructed at a position lower than the roadway surface, and the concave surface s1 houses the floating body connection-type flap gate 1 (in a lowered state). In this roadway surface-buried type, a drainage channel is provided for draining water from the concave surface s1 to the sea (or to a river).

On the other hand, the type which is mounted on the roadway surface has the floating body connection-type flap gate 1 (in a lowered state) mounted on the roadway surface at the opening, and is constructed at a position on the same level as the roadway surface.

According to the present invention, the door body 2 which forms the floating body connection-type flap gate 1 has a structure which is separated into three door body blocks 2*a*-2*c* in the vertical direction, which are hollow steel structures, for example. In the following description, these three door body blocks 2*a*-2*c* are referred to as a front end door body block 2*a*, a second door body block 2*b*, and a base end door body block 2*c*, that is, starting from the upper portion in the vertical direction.

The door body blocks 2*a*-2*c* which are separated in the vertical direction, and the base end door body block 2*c* and the roadway surface s, are connected by a rotation mechanism for rotation at a specified angle within a vertical plane in a direction in which the water w is trying to flow in from the opening d.

A rotation mechanism which connects the front end door body block 2*a* and the second door body block 2*b* is referred to as a first rotation mechanism 3*a*. A rotating mechanism which connects the second door body block 2*b* and the base end door body block 2*c* is referred to as a second rotation mechanism 3*b*. A rotation mechanism which connects the base end door body block 2*c* and the roadway surface s is referred to as a third rotation mechanism 3*c*.

These rotation mechanisms 3*a*-3*c* are formed, for example, with a structure described as follows.

The first rotation mechanism 3*a* is provided, for example, with two arc-shaped guide slots 3*aa* and 3*ab* formed at different radial positions in the end portion of the second door body block 2*b* adjacent to the front end door body block 2*a*. At the same time, moving pins 3*ac* and 3*ad* which are guided within these guide slots 3*aa* and 3*ab* are provided at the same radial positions as the arc-shaped guide slots 3*aa* and 3*ab* in the end portion of the front end door body block 2*a* adjacent to the second door body block 2*b*.

Likewise, the second rotation mechanism 3*b* is provided with, for example, two arc-shaped guide slots 3*ba* and 3*bb* formed at different radial positions in the end portion of the base end door body block 2*c* adjacent to the second door body block 2*b*. At the same time, moving pins 3*bc* and 3*bd* which are guided within these guide slots 3*ba* and 3*bb* are provided at the same radial positions as the arc-shaped guide slots 3*ba* and 3*bb* in the end portion of the second door body block 2*b* adjacent to the base end door body block 2*c*.

The third rotation mechanism 3*c* is provided with, for example, two arc-shaped guide slots 3*ca* and 3*cb* formed at different radial positions on the roadway surface s adjacent to the base end door body block 2*c*. At the same time, moving pins 3*cc* and 3*cd* which are guided within these guide slots 3*ca* and 3*cb* are provided at the same radial positions as the arc-shaped guide slots 3*ca* and 3*cb* in the end portion of the base end door body block 2*c* adjacent to the roadway surface s.

In such rotation mechanisms 3*a*-3*c*, the door body blocks 2*a* and 2*b*, the door body blocks 2*b* and 2*c*, and the roadway surface s and the door body block 2*c* rotate relative to each other with the radial centers of the arc-shaped guide slots 3*aa*, 3*ab*, 3*ba*, 3*bb*, 3*ca*, and 3*cb* serving as centers of rotation.

According to the present invention having the above construction, when the water w flows in from the opening d, the separated door body blocks 2*c*, 2*b*, and 2*a* rotatively rise in sequence from the roadway surface s, as shown in FIGS. 6(*a*)-(*d*) in response to the water level of the water w which flows in. Therefore, the door body as a whole does not shake significantly, regardless of the water level.

When this operation occurs, the rotational angles between the door body blocks 2*a* and 2*b*, between the door body blocks 2*b* and 2*c*, and between the roadway surface s and the door body block 2*c* are set by determining the optimal length of the arc shape of the arc-shaped guide slots 3*aa*, 3*ab*, 3*ba*, 3*bb*, 3*ca*, and 3*cb*.

For example, the lengths of the arc shape of the arc-shaped guide slots 3*aa*, 3*ab*, 3*ba*, and 3*bb* are determined so that the first and second rotation mechanisms 3*a* and 3*b* rotate at 70° in the direction in which the water w is trying to flow in from the opening d. The lengths of the arc shape of the arc-shaped guide slots 3*ca* and 3*cb* are determined so that the third rotation mechanism 3*c* rotates at 75° in the direction in which the water w is trying to flow in from the opening d.

If the range of the rotation angle of the first and second rotation mechanisms 3*a* and 3*b* and the third rotation mechanism 3*c* is determined in the above-described manner, when the rotation angle of the base end door body block 2*c* exceeds 70°, the hydrodynamic force to which the base end door body block 2*c* is subjected raises the second door body block 2*b* from the surface of the water by pulling it up from the water surface.

Accordingly, the speed at which the base end door body block 2*c* rises is reduced immediately before the door body block has finished rising, so that the force of impact is mitigated, with the result that there is no damage to the door body, even if the water w flows in with a high hydrodynamic force while the door body is rising.

In addition to restricting the arc length of the guide slots 3*aa*, 3*ab*, 3*ba*, 3*bb*, 3*ca*, and 3*cb* as described above, the total bending angle of all of the rotation mechanisms 3*a*-3*c* is also restricted by means of a wire rope 6 which extends from the roadway surface s to the door body block 2*a*, passing through the door body block 2*c* and the door body block 2*b*. Such a construction makes it possible to prevent the door body blocks 2*a*-2*c* which are separated into three from being wound when the floating body connection-type flap gate 1 moves to a lowered position.

Moreover, the length of the arc shape of the arc-shaped slots 3*aa* and 3*ab* is determined so that a first rotation mechanism 3*a* rotates an angle of 15°, for example, in a direction opposite to the direction in which the water w is trying to flow in from the opening d.

In the case of such a construction, the front end door body block 2*a* rises ahead of the influx of the water w, as shown in FIG. 7. It is therefore possible to direct the inflowing water w to the lower side of the door body blocks 2*b* and 2*c* which are in a lowered state, and making it possible to increase the speed of the operation of raising the door body blocks 2*a*-2*c* when the water w starts to flow into the opening d, to thereby prevent the influx of the water w from the opening, thus making it possible to prevent the water from leaking.

In the floating body connection-type flap gate 1 according to the present invention, it is advantageous to attach a water-tight member 4 in the vicinity of the center of rotation of the first to the third rotation mechanisms 3*a*-3*c*, as shown in FIG. 8.

If the water-tight member 4 is attached in such a position, then the water-tight member 4 can be prevented from stretching when the rotation mechanisms 3*a*-3*c* rotate, thereby making it possible to prevent damage to the water-tight member 4, even in cases where the door body 2 is repeatedly raised and lowered.

It should be noted that in cases where the water-tight member 4 is not attached in the vicinity of the center of rotation of the first to the third rotation mechanisms 3*a*-3*c*, a simple structure may be employed which utilizes shafts disposed in the center of rotation as the rotation mechanisms 3*a*-3*c* of the door bodies 2*a*-2*c*.

Reference Numeral 5 in FIG. 1 is a double-folding rod provided to the door body 2 on the side of the opening d, and serves to prevent the door body 2 from rotating at an angle which exceeds the angle at which the door body 2 has finished rising (e.g., 75°). The rod 5 also serves the function of mitigating the force of impact operating on the door body 2 immediately before the door body has finished rising.

It should be noted that a water-tight rubber member (not shown in the drawings) is attached to both sides of the door body blocks 2*a*-2*c*, to facilitate a close sliding of the sliding surfaces attached to both side walls of the opening d, so as to prevent water from leaking.

With reference to FIG. 6, the raising operation is described below for the case where the floating body connection-type flap gate 1 according to the present invention is disposed on the roadway surface s at the opening d in a seawall.

The floating body connection-type flap gate 1 according to the present invention, which has a door body 2 in which the three door body blocks 2*a*-2*c* are connected, rises from a lowered state in which there is no rising water as shown in FIG. 6(*a*) to a position shown in any of FIGS. 6 (*b*) to 6(*d*) depending on the level of the rising water.

FIG. 6(*a*) shows a situation in which no flooding or the like has occurred. In this case, the floating body connection-type flap gate 1 is housed in the concave surface s1 which is formed on the roadway surface s at the opening d.

In the lowered state shown in FIG. 6(*a*), when water rises due to a flood, for example, buoyancy and water pressure due to the rising water w operate on the floating body connection-type flap gate 1 which is in a lowered position. As a result of this buoyancy and water pressure, only the base end door body block 2*c* rotates upward in the direction opposite to the opening d, with the center of rotation of the third rotation mechanism 3*c* serving as a support point, and starts to rise. In this state, as shown in FIG. 6(*b*), unlike the base end door body block 2*c*, the two door body blocks 2*a* and 2*b* float on the water surface whereby the uppermost surface of the front end door body block 2*a* serves the function of a wall which prevents infiltration of water.

As the water continues to rise above the level shown in FIG. 6 (*b*), the water pressure operating on the floating body connection-type flap gate 1 further increases due to the increase in the water w, and the second door body block 2*b* rotates upward in the direction opposite to the opening d, with the center of rotation of the second rotation mechanism 3*b* serving as a support point, and starts to rise. In this state, as shown in FIG. 6(*c*), only the first rotation mechanism 3*a* bends, and the front end door body block 2*a* is in a state in which it floats on the surface of the water.

As the water continues to rise above the level shown in FIG. 6(*c*), the water pressure operating on the floating body connection-type flap gate 1 further increases due to the increase in the water w, and the front end door body block 2*a* rotates upward in the direction opposite to the opening d, with the center of rotation of the first rotation mechanism 3*a* serving as a support point, and starts to rise. In this state, as shown in FIG. 6(*d*), all of the door body blocks 2*a*-2*c* finish rising.

Following is a description of the operation of lowering the floating body connection-type flap gate 1 according to the present invention from the raised state shown in FIG. 6(*d*) to the state when it is lowered to the roadway surface 3 at the opening d shown in FIG. 6(*a*).

FIG. 6(*d*) shows a state prior to contending with a flood or the like. In this case, all of the door body blocks 2*a*-2*c* of the floating body connection-type flap gate 1 are in a raised state.

In FIG. 6(*d*) in which all of the door body blocks 2*a*-2*c* of the floating body connection-type flap gate 1 are in a raised state, when the water level drops, for example, there is reduced water pressure operating on the floating body connection-type flap gate 1 in a raised state. As a result of this reduced water pressure, the front end door body block 2*a* rotates downward in the direction to the opening d, with the center of rotation of the first rotation mechanism 3*a* serving as a support point, and starts to lower. In this state, as shown in FIG. 6(*c*), only the first rotation mechanism 3*a* bends, and the front end door body block 2*a* is in a state in which it floats on the surface of the water.

As the water continues to drop below the level shown in FIG. 6(*c*), the water pressure operating on the floating body connection-type flap gate 1 further decreases, and the second door body block 2*b* rotates downward in the direction to the opening d, with the center of rotation of the second rotation mechanism 3*b* serving as a support point, and starts to lower. In this state, as shown in FIG. 6 (*b*), only the second rotation mechanism 3*b* bends, so that the front end door body block 2*a* and the second door body block 2*b* are in a state in which they float on the surface of the water.

As the water continues to drop below the level shown in FIG. 6 (*b*), the water pressure operating on the floating body connection-type flap gate 1 further decreases, and the base end door body block 2*c* rotates downward in the direction to the opening d, with the center of rotation of the third rotation mechanism 3*c* serving as a support point, and starts to lower. Finally, as shown in FIG. 6(*a*), all of the door body blocks 2*a*-2*c* are completely housed in the concave surface s1.

The present invention is not limited to the above-described example, and the preferred embodiment may, of course, be advantageously modified within the scope of the technical ideas recited in the claims.

For example, a cover may be attached to an inner surface of the rotation mechanisms 3*a*-3*c*, in order to prevent debris from getting caught in the rotation mechanisms 3*a*-3*c*.

Moreover, the door body 2 can be prevented from being wound up when the water level is low, because the total bending angle of all of the door body blocks 2*a*-2*c* is restricted by adjusting the length of the wire rope 6 which passes through the door body blocks 2*a*-2*c*.

In addition, the floating body connection-type flap gate 1 according to the present invention may be without the double-folding rod 5. Also, the floating body connection-type flap gate 1 may be mounted on the roadway surface, rather than buried therein. In cases such as these, the operations of raising and lowering the floating body connection-type flap gate 1 are essentially the same as in the example of the present invention described above.

The invention claimed is:

1. A floating body connection-type flap gate disposed on a roadway surface in an opening, comprising a door body, which rises to block the opening when water is trying to flow in from the opening from a horizontal direction toward the gate, by using water pressure of the water which is trying to flow in and a buoyancy of the door body, wherein the door body is formed with two or more door body blocks which are separated in a vertical direction in a deployed state, the vertically separated door body blocks being connected by a rotation mechanism for rotation relative to the horizontal axis, wherein a first block of the two or more door body blocks is closer to inbound water flow along the horizontal axis than a second block of the two or more door body blocks, when in a lower condition wherein the first door body block is configured to rotate at least partially away from the horizontal axis before the second door body block; and wherein the second door body block rotates to its final deployed position prior to the first door body block rotating to its final deployed position.

2. The floating body connection-type flap gate according to claim 1, wherein the rotation mechanism comprises:

an arc-shaped guide slot formed in an adjacent end of one of two vertically adjacent door blocks or formed in a roadway surface at a specified radial position from a center of rotation; and a movable pin which is guided by the guide slot along a radial position identical to the arc-shaped guide slot and formed in an adjacent end of the other of the two vertically adjacent door blocks or formed in a roadway surface.

3. The floating body connection-type flap gate according to claim 2, wherein a water-tight member is provided in a vicinity of the center of rotation, between adjacent ends of the first and second door body blocks and between a roadway surface and a door body block that is furthest from inbound water flow along the horizontal axis.

4. The floating body connection-type flap gate according to claim 1, wherein a range of an angle of rotation of the rotation mechanism is smaller than a range of an angle of rotation of a rotation mechanism provided between a door body block that is furthest from inbound water flow along the horizontal axis and a roadway surface.

5. The floating body connection-type flap gate according to claim 1, wherein a wire rope configured for use with a roadway surface extends to the first door body block, passing through a plurality of the door body blocks.

6. The floating body connection-type flap gate according to claim 4, wherein a wire rope configured for use with a roadway surface extends to the first door body block, passing through a plurality of the door body blocks.

7. The floating body connection-type flap gate according to claim 1, wherein the second block is positioned lower than the first block when the first and second blocks are in their respective final deployed positions.

* * * * *

UNITED STATES PATENT AND TRADEMARK OFFICE

CERTIFICATE OF CORRECTION

PATENT NO. : 9,011,042 B2
APPLICATION NO. : 13/522842
DATED : April 21, 2015
INVENTOR(S) : Kyouiti Nakayasu et al.

It is certified that error appears in the above-identified patent and that said Letters Patent is hereby corrected as shown below:

In the Claims

In column 8, claim 1, line 22, after "when in a" replace "lower condition" with --lowered condition,--.

Signed and Sealed this
Fifth Day of April, 2016

Michelle K. Lee

Michelle K. Lee
*Director of the United States Patent and Trademark Office*